United States Patent [19]

Wilson

[11] Patent Number: 4,759,656

[45] Date of Patent: Jul. 26, 1988

[54] CONSTRUCTION OF A MANHOLE CHIMNEY

[75] Inventor: Stephen K. Wilson, 629 S. Minerva, Royal Oak, Mich. 48067

[73] Assignee: Stephen K. Wilson, Royal Oak, Mich.

[21] Appl. No.: 912,788

[22] Filed: Sep. 29, 1986

[51] Int. Cl.[4] ..... E02D 29/14

[52] U.S. Cl. ..... 404/26; 52/20; 277/227; 277/228

[58] Field of Search ..... 404/25, 26; 52/19-21; 137/364, 371; 98/58; 277/201, 214, 227, 228, 233

[56] References Cited

U.S. PATENT DOCUMENTS

| | | | |
|---|---|---|---|
| 1,639,495 | 8/1927 | Frame | 404/26 |
| 3,629,981 | 12/1971 | McCaffery | 404/26 X |
| 3,926,533 | 8/1975 | Binette et al. | 404/26 |
| 4,121,390 | 10/1978 | Hall et al. | 52/20 |
| 4,408,421 | 10/1983 | Pai | 52/20 |
| 4,469,467 | 9/1984 | Odill et al. | 404/25 |
| 4,475,845 | 10/1984 | Odill et al. | 404/25 |

FOREIGN PATENT DOCUMENTS

| | | | |
|---|---|---|---|
| 2525285 | 9/1976 | Fed. Rep. of Germany . | |
| 11226 | 1/1983 | Japan | 52/20 |
| 2088446 | 6/1982 | United Kingdom . | |
| 2102479 | 2/1983 | United Kingdom . | |

OTHER PUBLICATIONS

Cretex, Manhole Sealing Products Brochure, copyrighted 1985.

*Primary Examiner*—Jerome Massie
*Assistant Examiner*—John F. Letchford
*Attorney, Agent, or Firm*—Harness, Dickey & Pierce

[57] ABSTRACT

A stackable elastomer adjustment ring is provided for the construction of the adjustment courses or manhole chimney portion of a sewer system. The adjustment ring is circular and includes concentric grooves in the upper and lower surfaces. Sealing rings are provided corresponding with the concentric grooves and are positioned between the adjustment rings in the grooves when the rings are stacked one on another. The adjustment rings are stacked one on another with respective sealing rings between them to provide a manhole construction which is resistant to infiltration, chemicals and freeze-thaw cycle damage.

5 Claims, 2 Drawing Sheets

CONSTRUCTION OF A MANHOLE CHIMNEY

TECHNICAL FIELD

The present invention relates to a construction of a manhole chimney. More specifically, the present invention relates to an elastomer adjustment ring which is used to construct the manhole chimney.

BACKGROUND OF THE INVENTION

Generally, the construction of a manhole includes an underground horizontal main sewer line having vertical access pipes or sections connected to the main sewer line which lead to a truncated cone and ultimately to a manhole frame and cover. On top of the cone a manhole chimney or adjustment courses are constructed which lead upward and are of the same diameter as the upper surface of the cone. The manhole frame is placed on top of this chimney and holds the manhole cover.

Past constructions of the manhole chimney or adjustment courses included using brick and mortar to build up the manhole chimney or in the alternative precast concrete rings have been used which are stacked on top of one another. The state of the art is generally shown in the following cited references: U.S. Pat. No. 1,639,495 issued to Frame; U.S. Pat. No. 3,926,533 issued to Binette; German Pat. No. 2,525,285; U.S. Pat. No. 4,121,390 issued to Hall; U.K. Pat. No. 2,088,446; U.K. Pat. No. 2,102,479, U.S. Pat. No. 4,408,421 issued to Pai; and U.S. Pat. No. 4,469,467 issued to Odill, et al.

Upon completion of the construction, the surrounding surface is back filled, and the upper surface is paved such that the manhole is generally flat with the surrounding roadway surface. In areas other than streets the top of the cover is also generally adjusted to the surrounding ground level.

Because of the numerous and varying stresses on these constructions, manhole chimney constructions of the past have been prone to rapid deterioration. For instance, the hydrogen sulfide gas and other chemicals commonly found in sewer systems, may be corrosive to cement and may tend to deteriorate the preformed rings or the cement which holds the brick constructions together. In addition, the freeze-thaw cycles of the surrounding ground place strong pressure on the construction and may crush the construction. These freeze-thaw cycles may also work to widen any cracks or deformations in the structure thereby breaking down the structure. Also jolts or shock waves produced by passing traffic and road scrapers accentuate the destructive forces acting on the construction thereby breaking down the construction even sooner. Because of these and other problems the integrity of the structure is eventually broken such that water and sediment may be permitted to flow through the manhole chimney and into the sewer system.

This process is called infiltration and is undesireable in a sewer system in that these sediments may cause clogging of the sewer system or create undesireable conditions for workers working inside the sewer system. In addition, infiltration may soon result in a void in the underlying support of the roadway surface were the sediment has entered through the breaches in the manhole chimney, which may then cause structural problems with the roadway surface since it is not supported where the void occurs.

The precast spacing rings of the past have also been troublesome to install in a manhole chimney. These precast rings are heavy and require heavy equipment or several men to install. In addition these rings tend to be somewhat fragile and may shatter or crack if dropped or mishandled.

In the past, constructions have been attempted wherein seals have been placed between the precast ring in an attempt to stop the infiltration problem. In addition, as disclosed in U.S. Pat. No. 4,469,467 issued to Odill and assigned to Cretex Companies, manhole chimney seals have been attempted which seal the manhole chimney by a rubber tubular seal placed either on the inside or the outside of the manhole chimney. However, these constructions may still allow freeze-thaw damage or other damage to the chimney construction to occur.

SUMMARY OF THE INVENTION

The present invention provides an adjustment ring for use in a construction of a manhole chimney which includes a continuous elastomer ring that can be stacked one on another for providing a construction of the chimney portion of a sewer system.

It is an object of the present invention to provide a chimney construction which is free from infiltration and which is resistant to chemicals, freeze-thaw damage, infiltration, and which will absorb road shock from passing automobiles and road scrapers and retain its structural integrity.

It is a further object of the present invention to provide a lightweight yet rigid and durable adjustment ring for use in the construction of a manhole chimney and which will provide economical installation and would not be prone to damage from mishandling or dropping of the ring.

DESCRIPTION OF THE DRAWINGS

Other advantages of the present invention will be readily appreciated as the same becomes better understood by reference to the following detailed description when considered in connection with the accompanying drawings wherein.

DESCRIPTION OF THE INVENTION

Figure 1:
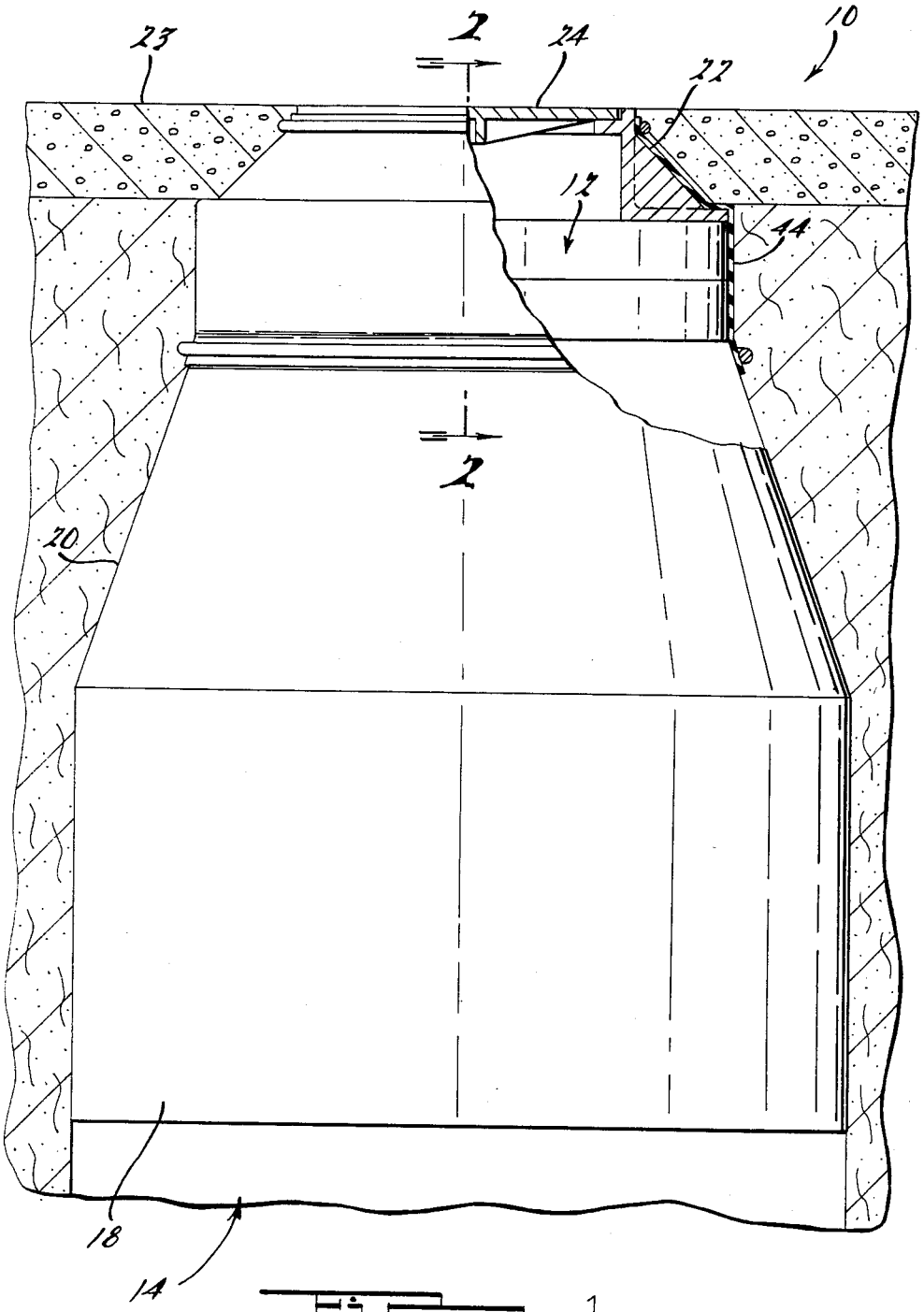
FIG. 1 is an overall view partially broken away of a manhole chimney construction of the present invention.

According to the present invention, there is provided an adjustment ring for use in the construction of a manhole chimney assembly, generally indicated at 10. More specifically, continuous elastomer rings 12 are provided for stacking one on another, thus providing a construction of the chimney portion of a manhole access to a sewer system.

In general, during the construction of a sewer system, manholes are provided for access by workmen to the sewer line. The sewer system 14 includes a main sewer line (not shown) which has vertical access pipe or riser 18 rising from it and leading to a cone 20. The invention of the chimney assembly 10 is generally constructed on top of the cone 20. In the present invention the continuous elastomer construction rings 12 are stacked one on another, and the frame 22 of the manhole cover 24 is placed on top of the uppermost elastomer construction ring 12.

The rings 12 of the present invention each include one or more continuous grooves 16. A continuous seal 26 is positioned in each continuous groove 16 between the continuous elastomer rings 12 for sealing the manhole chimney assembly 10 from infiltration.

Figure 2:
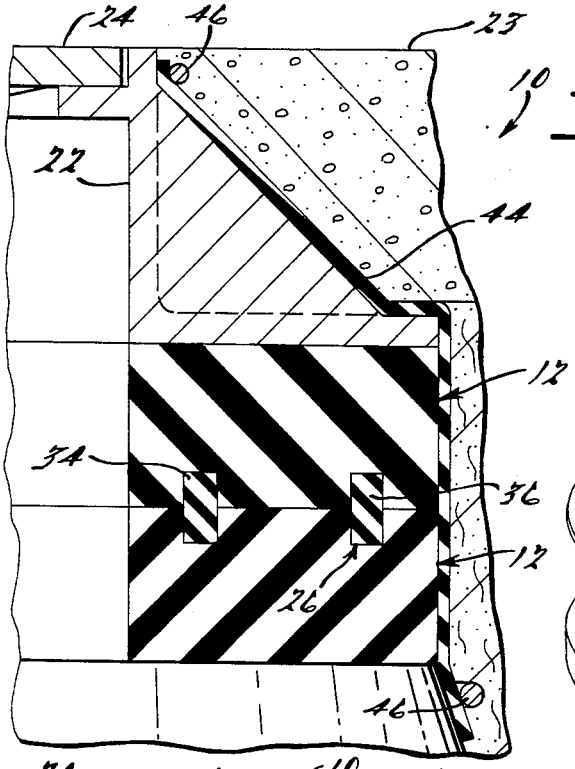
FIG. 2 is a detailed cross sectional view of the elastomer ring construction of a manhole chimney, of the present invention.
Figure 4:
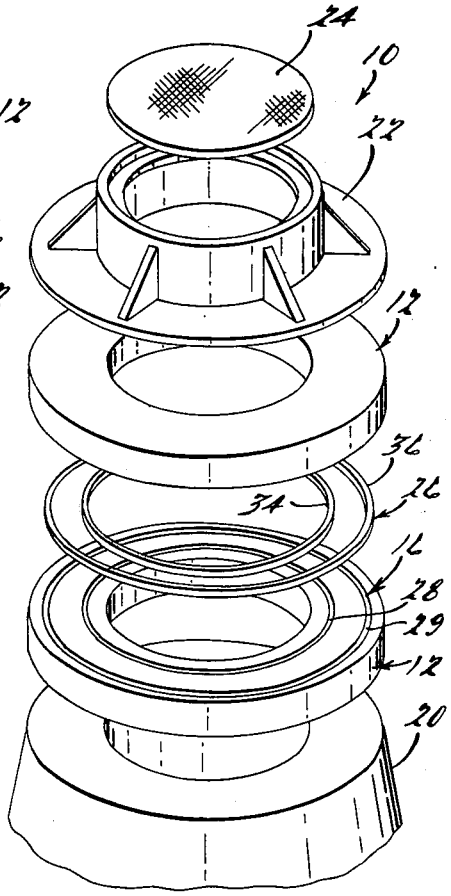
FIG. 4 is an exploded view of a manhole chimney construction of the present invention.
Figure 5:
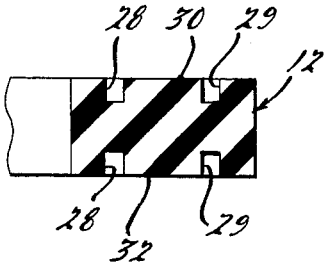
FIG. 5 is a cross sectional view of an embodiment of the elastomer ring of the present invention.

Referring now to FIG. 5, each of the continuous elastomer construction rings 12 has an upper surface 30 and a lower surface 32, each of which includes grooves 28 and 29. A pair of elastomer sealing rings 34 and 36 are positioned in the grooves 28 and 29, respectively, in the upper surface 30 of one of the continuous elastomer rings 12 and in the grooves 28 and 29, respectively, in the lower surface 32 of the other ring 12 when the rings 12 are stacked on one another, as illustrated in FIG. 4. In some applications it may be preferable that one surface of the top ring and of the bottom ring may contain no grooves, thus providing an increased seal at the cone and manhole frame as shown in FIGS. 2 and 3.

As shown in FIGS. 4 and 5, in a preferred embodiment of the invention, the construction rings 12 are annular in configuration and include a pair of concentric grooves 28 and 29 in one or both of the upper 30 and lower 32 surfaces of each ring 12. In this construction a pair of concentric sealing rings 34 and 36 are provided corresponding to the diameter of the annular grooves 28 and 29. When the rings 12 are placed on top of the cone 20 of a sewer system initially a layer of mastic may be placed between the cone and the first ring. Thereafter, the rings 12 are stacked one upon another with the sealing rings 34 and 36 positioned in the grooves 28 and 29 between adjacent rings 12 until the level of the upper surface of the manhole frame 22 is even with the roadway surface 23 or ground level. The manhole frame is then placed on top of the top construction ring which is then back filled and paved around, thereby holding the frame 22 in place.

Figure 3:
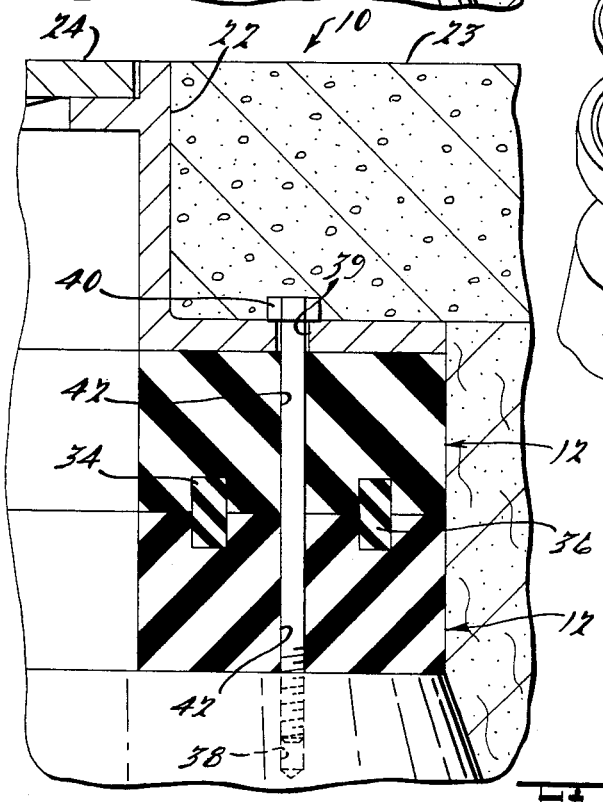
FIG. 3 is a detailed cross sectional view of an alternate construction of a manhole chimney of the present invention.

In some applications, as shown in FIG. 3, mollies 38 are provided in the cone 20, and the frame 22 has corresponding holes 39 which would allow bolts 40 to secure the system together. Therefore, the rings 12 may be accompanied by a series of aligned vertical holes 42 through which bolts 40 are placed to hold the frame 22 onto the cone 20.

The rings 12 may be made out of any type elastomer composition which is impervious to the elements and chemicals, and which will absorb shock without incident.

In a preferred embodiment of the invention a relatively firm elastomeric material is used for construction of the rings 12 and sealing rings 34 and 36 of the present invention. Preferably an elastomer material is used which is taken from the group of butyl rubber; plasticized polyvinyl chloride; butyl polyvinyl chloride; natural rubber; neoprene or a silicon rubber. However, the rings 12 and sealing rings 34 and 36 of the present invention may be constructed of any material such as a plastic, rubber elastomeric or other material, provided the composition used: is structurally sound; will absorb shock; is generally impervious to sulfides and other gases found in a sewer system; and is freeze-thaw cycle resistant.

In addition, to facilitate the placement of the sealing rings 34 and 36 into grooves 28 and 29 a lubricant may be used to help position these sealing rings in grooves 28 and 29.

Thus a construction is provided wherein the chimney portion of a manhole is substantially impervious to infiltration, damage from freeze-thaw cycles, and damage from shocks of vehicles and scrapers.

Also provided in one form of the present invention is a veil 44 which may be used in particularly harsh climates to further seal the construction from infiltration and other types of damage. The veil 44 is a continuous elastomer tube which is secured around the circumference of the manhole frame 22 and the outside circumference of the cone 20 with stainless steel clamps 46. In areas where the chimney portion of the manhole is extremely long, the veil 44 may be operatively positioned by being attached in sealed engagement with the outside circumference of the manhole frame, and the lower portion of the veil is circumferentially attached to the elastomer rings of the chimney at a point below the freeze line in the surrounding ground surface. Thus, the present invention may be practiced with or without the veil depending on the location of the manhole and the surrounding conditions.

As will be appreciated to those skilled in the art the manhole chimney construction of the present invention may be used during initial construction of a sewer system. Also, the construction of the present invention may be readily used to replace existing constructions or those which have been damaged.

The present invention has been described in an illustrative manner, using words of description rather than of limitation. Many modifications and variations of the present invention are possible in light of the above teachings. It is therefore to be understood, that within the scope of the appended claims the invention may be practiced otherwise than as specifically described without deviating from the scope of the present invention.

What is claimed is:

1. In a manhole assembly having a longitudinally upper frame portion disposed on a longitudinally lower cone portion, an improved structure for substantially preventing inflow and infiltration of water or other material between the upper frame portion and the lower cone portion, the improvement comprising:

a plurality of continuous and compressible elastomeric spacer rings serially stacked longitudinally and laterally aligned with one another between the upper frame portion and the lower cone portion, one of said spacer rings being sealingly secured to the frame portion and another of said spacer rings being sealingly secured to the cone portion, a longitudinally adjacent pair of said spacer rings having generally flat sides longitudinally confronting one another and having at least a pair of laterally spaced concentric annular grooves formed in each of said confronting sides with said annular grooves in said confronting sides being laterally aligned with one another when said spacer rings are laterally aligned with one another; and at least a pair of continuous and generally cylindrical annular elastomeric sealing rings corresponding to said annular grooves, each of said sealing rings being sealingly received within one of said laterally concentric annular grooves in each of said confronting sides of said adjacent spacer rings, said annular grooves being generally cylindrical and having a generally rectangular longitudinal cross-sectional shape with two sides of said rectangular cross-sectional shape being oriented longitudinally, and said cylindrical sealing rings having a complementary generally rectangular longitudinal cross-sectional shape in order to tend to resiliently maintain said spacer rings generally in a lateral alignment with one another, said complementary rectangular cross-sectional shapes of said sealing rings and said annular grooves allowing for longitudinal movement of the frame portion and the cone portion relative to one another while still sealing between said spacer rings and substantially preventing said inflow and infiltration between the frame portion and the cone portion, said pair of laterally spaced concentric annular grooves with said corresponding pair of said sealing rings received therein allowing for lateral tilting movement of the frame portion and the cone portion relative to one another while still sealing between spacer rings and substantially preventing said inflow and infiltration.

2. The invention according to claim 1, wherein at least one of said spacer rings has a pair of said confronting sides on opposite longitudinal sides thereof, each of said confronting sides having said laterally spaced concentric annular grooves formed therein for receiving said sealing rings therein.

3. The invention according to claim 1, further comprising an elastomeric veil generally surrounding said spacer rings and at least a portion of each of the frame portion and the cone portion.

4. The invention according to claim 3, further comprising lateral clamping means for clamping said veil in sealing engagement with the outside of the frame portion and with the outside of the cone portion.

5. The invention according to claim 1, further comprising longitudinal clamping means for clampingly urging the frame portion and the cone portion longitudinally toward one another with said spacer rings and said sealing rings therebetween.

* * * * *

UNITED STATES PATENT AND TRADEMARK OFFICE

CERTIFICATE OF CORRECTION

PATENT NO. : 4,759,656

DATED : July 26, 1988

INVENTOR(S) : Stephen K. Wilson

It is certified that error appears in the above-identified patent and that said Letters Patent is hereby corrected as shown below:

Column 1, line 62, "were" should be --where--.

Column 3, line 61, "silicon" should be --silicone--.

Signed and Sealed this

Seventeenth Day of January, 1989

*Attest:*

DONALD J. QUIGG

*Attesting Officer*

*Commissioner of Patents and Trademarks*